US011812883B2

(12) United States Patent
Hanley

(10) Patent No.: US 11,812,883 B2
(45) Date of Patent: Nov. 14, 2023

(54) CURTAIN ROD BRACKET

(71) Applicant: Kenney Manufacturing Company, Warwick, RI (US)

(72) Inventor: Michael P. Hanley, Smithfield, RI (US)

(73) Assignee: Kenney Manufacturing Company

( * ) Notice: Subject to any disclaimer, the term of this patent is extended or adjusted under 35 U.S.C. 154(b) by 0 days.

(21) Appl. No.: 16/775,030

(22) Filed: Jan. 28, 2020

(65) Prior Publication Data

US 2020/0305629 A1 Oct. 1, 2020

Related U.S. Application Data

(60) Provisional application No. 62/823,398, filed on Mar. 25, 2019.

(51) Int. Cl.
*A47H 1/142* (2006.01)
*A47H 1/102* (2006.01)
*A47H 1/122* (2006.01)

(52) U.S. Cl.
CPC ..... *A47H 1/142* (2013.01); *A47H 1/102* (2013.01); *A47H 1/122* (2013.01)

(58) Field of Classification Search
CPC ..... A47H 1/142; A47H 1/102; A47H 1/122; A47H 1/10; A47H 1/12; A47H 1/14; A47H 1/13; A47H 1/022; A47H 1/04; A47H 1/02; F16M 13/02; E04B 2001/2644; E04B 7/045; E04B 1/2608; E04B 2001/405
USPC ..... 248/265
See application file for complete search history.

(56) References Cited

U.S. PATENT DOCUMENTS 507,266 A * 10/1893 Fraley ..... A47H 1/13 248/252
511,431 A * 12/1893 Hutchinson et al. .... A47H 1/13 248/259
692,144 A * 1/1902 Kenvin ..... A47H 1/13 248/258
736,533 A * 8/1903 Middlemiss ..... A47H 1/13 248/259
752,425 A * 2/1904 Spangler ..... A47H 1/13 248/259
762,594 A * 6/1904 Michaels ..... E06B 9/50 248/216.1
796,238 A * 8/1905 Morris ..... A47H 1/13 248/258
798,683 A * 9/1905 Ketteman ..... A47L 3/02 182/61
819,362 A * 5/1906 Miller ..... A47H 1/13 248/254
826,040 A * 7/1906 Livelsberger ..... A47H 1/13 248/260
910,273 A * 1/1909 Dougherty ..... A47H 1/13 248/258
924,248 A * 6/1909 Lazear ..... A47H 1/022 211/105.2
937,457 A * 10/1909 Moffat ..... A47H 1/142 248/265
1,022,319 A * 4/1912 Kenitz et al. ..... A47H 1/13 248/260

(Continued)

*Primary Examiner* — Taylor Morris
(74) *Attorney, Agent, or Firm* — Adler Pollock & Sheehan P.C

(57) ABSTRACT

A curtain rod bracket includes a bracket insert, a mounting plate, an adjustable fastener, and mounting spikes.

6 Claims, 6 Drawing Sheets

(56) References Cited

U.S. PATENT DOCUMENTS 1,025,920 A * 5/1912 Meek ..... A47H 1/13 248/260
1,053,796 A * 2/1913 Emery ..... A47H 1/13 248/254
1,080,370 A * 12/1913 Shieding ..... A47H 1/13 248/259
1,126,934 A * 2/1915 Allard ..... A47H 1/13 248/258
1,169,259 A * 1/1916 Houston ..... A47H 1/13 248/257
1,173,915 A * 2/1916 Baldaccini ..... A47H 1/13 248/254
1,265,044 A * 5/1918 Bruederly ..... A47H 1/13 248/258
1,350,623 A * 8/1920 Schenmeyer ..... A47H 1/13 248/272
1,370,817 A * 3/1921 Jackson ..... A47H 1/13 160/112
1,373,397 A * 4/1921 Arntz ..... A47H 1/13 248/256
1,502,935 A * 7/1924 Bohrer ..... A47H 1/13 248/252
1,504,810 A * 8/1924 Byron ..... A47H 1/022 211/105.6
1,522,584 A * 1/1925 Grimes ..... A47H 1/122 248/259
1,561,617 A * 11/1925 Renzenbrink ..... A47H 1/13 248/271
1,575,459 A * 3/1926 Storts ..... A47H 1/13 248/260
1,598,239 A * 8/1926 Bruckner ..... A47H 1/122 248/272
1,636,835 A * 7/1927 Rasp ..... A47H 1/122 248/255
1,643,061 A * 9/1927 Denney ..... A47H 1/13 248/256
1,786,991 A * 12/1930 Greim ..... E04B 1/2604 403/174
1,809,216 A * 6/1931 Quandt ..... A47H 27/00 248/300
2,056,874 A * 10/1936 Updegraff ..... A47H 1/122 248/265
2,079,816 A * 5/1937 Rose ..... A47H 1/122 248/265
2,168,421 A * 8/1939 Reynolds ..... A47H 1/13 248/263
2,293,919 A * 8/1942 Rabe ..... A01M 1/2055 43/131
2,310,928 A * 2/1943 Behrle ..... A47H 1/122 211/105.2
2,433,527 A * 12/1947 Mohr ..... A47H 1/122 248/265
2,480,360 A * 8/1949 Doty ..... A47H 1/13 248/252
2,506,160 A * 5/1950 Martin ..... A47H 1/13 248/255
2,522,288 A * 9/1950 Light ..... A47H 1/022 248/265
2,545,147 A * 3/1951 Jensen ..... A47H 1/13 248/259
2,562,836 A * 7/1951 Veschio ..... A47H 1/14 211/96
2,568,043 A * 9/1951 Wagner ..... F16B 5/0614 411/456
2,570,731 A * 10/1951 Susnow ..... A47H 1/12 248/247
2,653,718 A * 9/1953 Woodward ..... A47H 1/122 211/105.2
2,679,373 A * 5/1954 Henley ..... A47H 1/142 248/262
2,689,103 A * 9/1954 Ackerman ..... A47H 1/122 248/257
2,703,179 A * 3/1955 Giambra, Jr. ..... A47H 1/02 223/105
2,783,014 A * 2/1957 Kenney ..... A47H 1/13 248/263
2,964,280 A * 12/1960 Rinaldi ..... A47H 1/122 248/265
3,049,327 A * 8/1962 Caudell ..... A47H 1/122 248/220.1
3,090,588 A * 5/1963 Monette ..... A47H 1/142 248/217.3
3,113,678 A * 12/1963 Dickinson ..... A47B 96/061 108/29
3,160,384 A * 12/1964 Cirese ..... A47H 1/122 248/265
3,430,908 A * 3/1969 Kowalczyk ..... A47H 1/102 248/265
3,702,591 A * 11/1972 Banse ..... A47B 96/027 211/90.01
3,704,851 A * 12/1972 Cormier ..... A47H 1/10 248/265
3,889,912 A * 6/1975 Ray ..... A47H 1/14 248/269
4,079,771 A * 3/1978 Theiss ..... A47H 1/102 160/102
4,136,847 A * 1/1979 Murray ..... A47H 1/142 248/265
4,322,050 A * 3/1982 Roach ..... A47H 1/122 248/222.51
4,417,712 A * 11/1983 DeHart ..... G09F 7/18 248/220.22
4,465,198 A * 8/1984 Martin ..... A47K 10/04 211/105.3
4,762,162 A * 8/1988 Chochrek ..... A47K 10/38 248/909
5,082,226 A * 1/1992 Mahan ..... A47H 1/102 248/253
5,193,775 A * 3/1993 Wagnon ..... A47H 1/10 160/330
5,253,831 A * 10/1993 Theodorides ..... H02G 3/126 248/225.11
5,307,603 A * 5/1994 Chiodo ..... E04B 1/2608 52/297
5,398,900 A * 3/1995 Schober ..... A47H 1/142 248/251
5,472,102 A * 12/1995 Clayton ..... A47H 1/142 248/265
5,641,143 A * 6/1997 Garza ..... A47H 1/142 248/263
6,101,780 A * 8/2000 Kreidt ..... E04B 1/2608 52/281
6,224,030 B1 * 5/2001 Hepworth ..... A47G 25/0614 248/215
7,028,960 B2 * 4/2006 Goldstein ..... A47H 1/124 248/262
7,198,088 B2 * 4/2007 McMenamin ..... E06B 9/38 160/123
8,418,975 B1 * 4/2013 Burr ..... A47H 1/142 248/261
8,550,263 B2 * 10/2013 Martin ..... A47K 1/08 211/175
10,092,126 B2 * 10/2018 Baines ..... A47H 1/12
10,542,835 B1 * 1/2020 Suozzo ..... A47H 1/142
2006/0080934 A1 * 4/2006 Petrova ..... F16B 15/0046 52/848
2008/0178538 A1 * 7/2008 Green ..... E04B 1/2604 52/92.2
2009/0032659 A1 * 2/2009 Goldstein ..... A47H 1/122 248/220.21
2010/0189496 A1 * 7/2010 Smith ..... E04B 1/2608 403/384
2010/0212251 A1 * 8/2010 Llorens ..... E04B 7/045 52/712
2012/0217362 A1 * 8/2012 Affonso ..... A47H 1/142 248/222.14
2015/0107787 A1 * 4/2015 Ward ..... A47H 1/142 160/330

(56) References Cited

U.S. PATENT DOCUMENTS

| | | | | |
|---|---|---|---|---|
| 2016/0157655 | A1* | 6/2016 | Muniz | A47H 1/122<br>362/253 |
| 2016/0286999 | A1* | 10/2016 | McMillion | F16B 2/22 |
| 2018/0078073 | A1* | 3/2018 | Morris | F16B 2/08 |
| 2019/0153727 | A1* | 5/2019 | Stahl, Jr. | E04B 1/2403 |

* cited by examiner

CURTAIN ROD BRACKET

CROSS REFERENCE TO RELATED APPLICATIONS

This application claims benefit from U.S. Provisional Patent Application Ser. No. 62/823,398, filed Mar. 25, 2019, which is incorporated by reference in its entirety.

STATEMENT REGARDING GOVERNMENT INTEREST

None.

BACKGROUND OF THE INVENTION

This invention generally relates to brackets for supporting rods or rails for supporting rods, and more specifically to a curtain rod bracket.

In general, brackets have been used in the hardware industry for mounting curtain rods, shower curtain rods, and other rods to surfaces such as walls, windows, window frames, window casings, and ceilings. Brackets often include a hook-like feature in which a rod rests or a ring through which the rod passes.

One problem in using brackets of such construction is that nails or screws cause holes in the front face of the molding or the surrounding wall and after several repositionings, the wall may become damaged or the molding may become honeycombed with holes or even split. Thus, there remains a need in the hardware industry and arts for a bracket system which, when used to support curtain rods on wooden and other moldings, does not require screws or nails for prepositioning to the molding.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features a curtain rod bracket including a bracket insert, a mounting plate, an adjustable fastener, and mounting spikes.

In another aspect, the invention features a method including providing a curtain rod bracket, the curtain rod bracket including a bracket insert, a mounting plate, an adjustable fastener and mounting spikes, placing a wall section of the bracket insert into a rear wall portion receptacle of the mounting plate, positioning the mounting plate on an upper surface of a window casing with a spike of the mounting plate facing downward, and taping the mounting plate on to upper surface of a window casing, causing the spike to penetrate the window casing.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
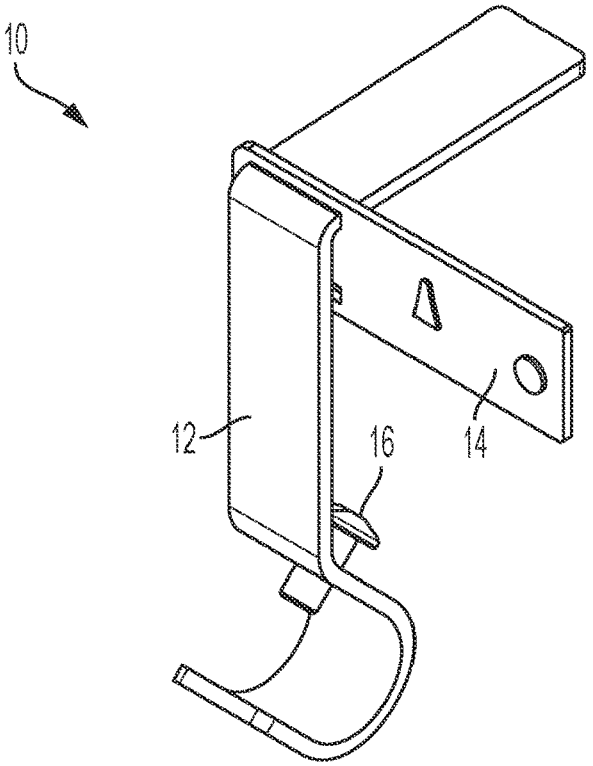
FIG. 1 is a diagram of a first embodiment of an exemplary curtain rod bracket.
Figure 2:
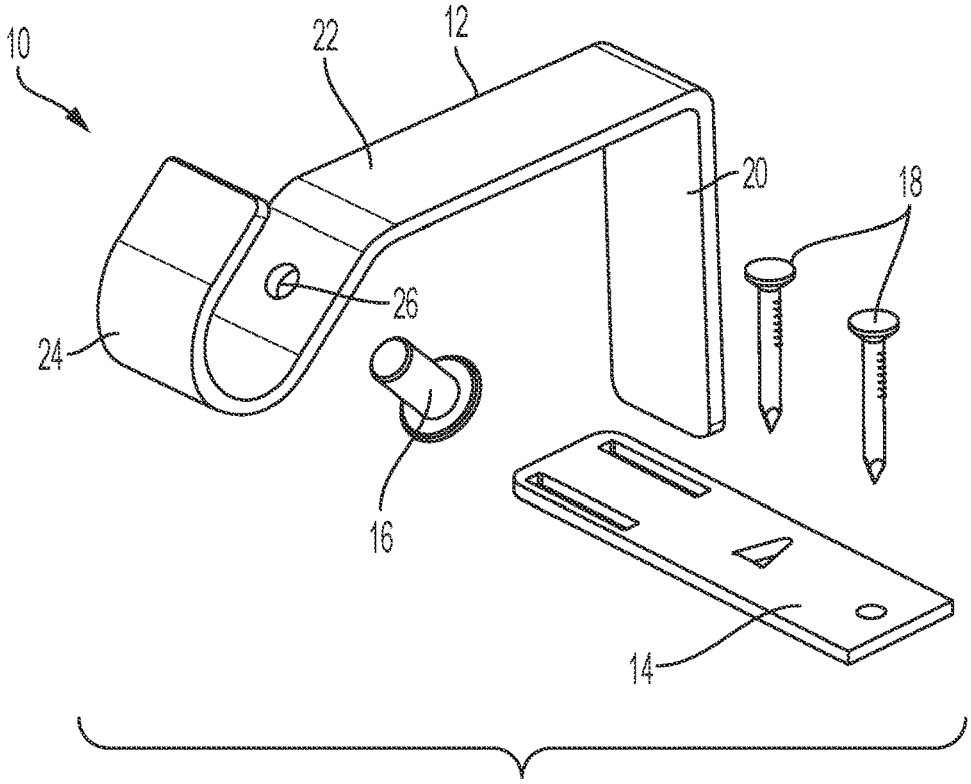
FIG. 2 is a component diagram of an exemplary curtain rod bracket of FIG. 1.
Figure 3:
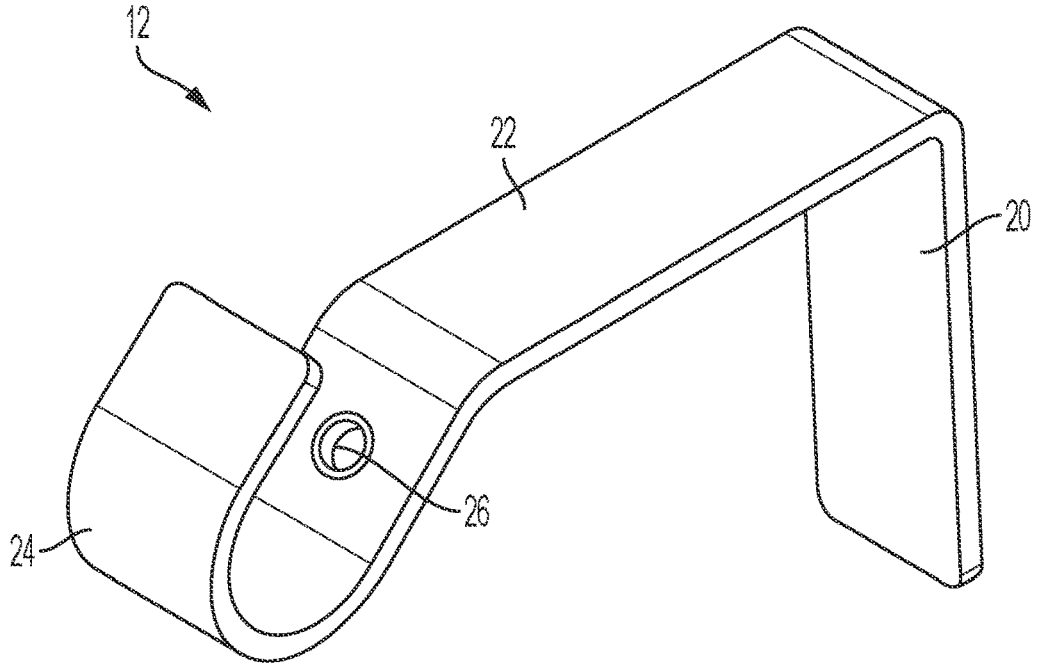
FIG. 3 is a diagram of a bracket insert.
Figure 4:
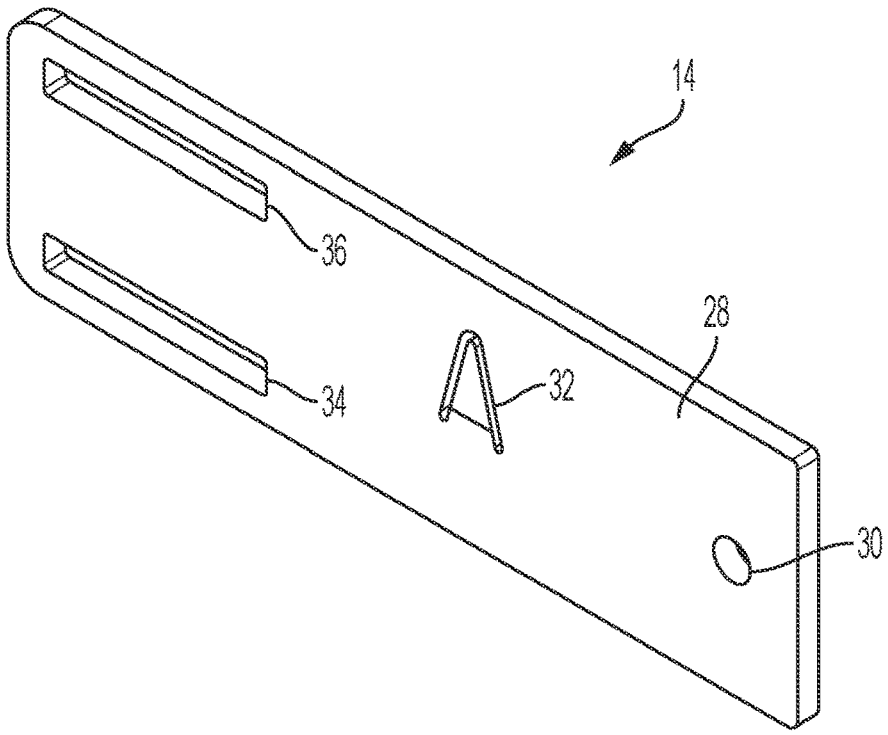
FIG. 4 is a diagram of a mounting plate.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIGS. 1-4, a first embodiment of an exemplary curtain rod bracket 10 includes a bracket insert 12, a mounting plate 14, an adjustable fastener 16 and mounting spikes 18. The bracket insert 12 is bent, resulting in two sections, i.e., a wall section 20 and an extension section 22. A distal end of the extension section 22 includes a cradle portion 24. The cradle portion 24 includes an aperture 26 configured to receive the adjustable fastener 16.

The bend in the bracket insert 12 is such so as to provide stability to assembled curtain rod bracket 10 when properly mounted to a casing. In a preferred embodiment, the bend in the bracket insert 12 is 93°.

The cradle portion 24 is configured to receive a rod (not shown), such as a curtain rod. Once the rod is placed into the cradle portion 24, the adjustable fastener 16 is placed onto the aperture 26 and rotated until making contact with the rod to secure the rod within the cradle portion 24. In one example, the aperture 26 is threaded to received corresponding threads of the adjustable fastener 16.

An upper side 28 of the mounting plate 14 includes a securing aperture 30, a mounting spike aperture 32 and two parallel wall portion receptacles, or slots, 34, 36. The securing aperture 30 is configured to receive a tack (not shown). Each of the wall portion receptacles 34, 36 is configured to receive the wall section 20 of the bracket insert 12. The presence of two wall portion receptacles 34, 36 enable the wall section 20 to be positioned in one of two different positions with respect to a mounting surface (not shown).

Figure 5:
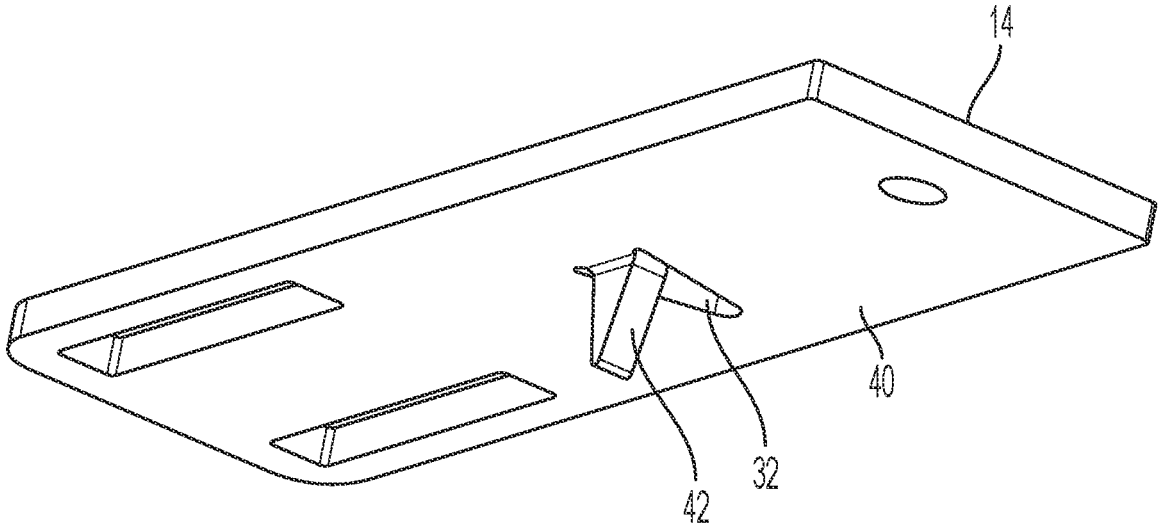
FIG. 5 is a diagram of an underside of the mounting plate of FIG. 4.

As shown in FIG. 5, an underside (or back) 40 of the mounting plate 14 includes a spike 42. The spike 42 aids in initial positioning and securing of the mounting plate 14 along a mounting surface, such as, for example, a top of a window casing.

Figure 6A:
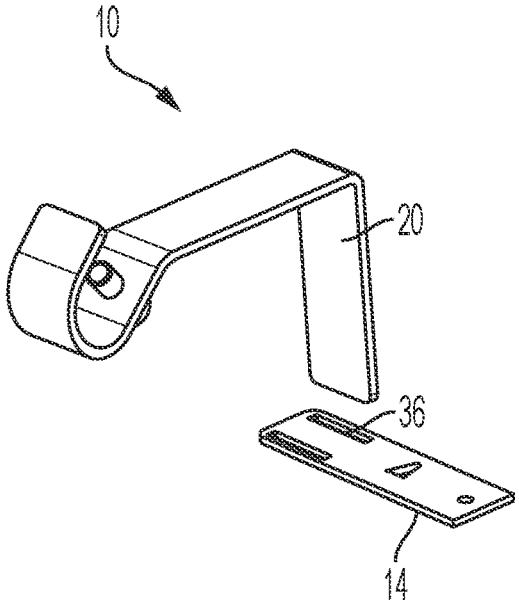
FIGS. 6A, 6B and 6C illustrate mounting of the exemplary curtain rod bracket of FIG. 1.
Figure 6B:
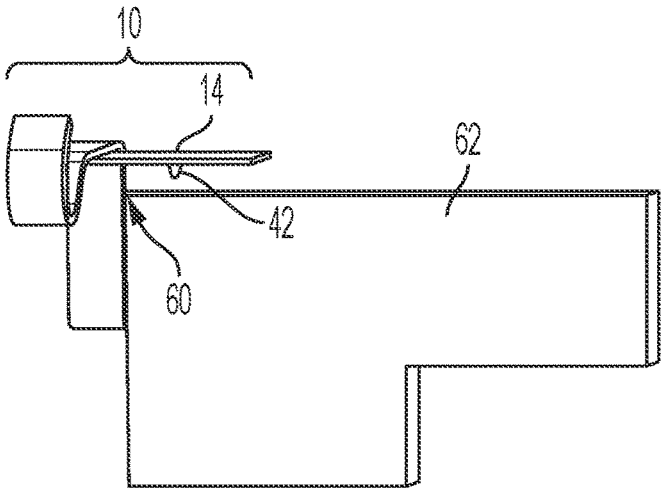
Figure 6C:
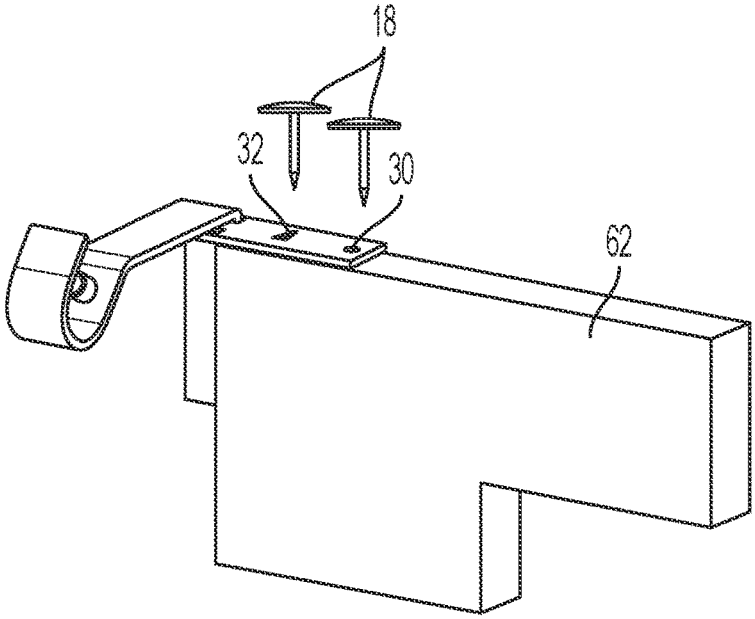

FIGS. 6A, 6B and 6C illustrate one method of attaching and securing he curtain rod bracket 10 on to a window casing. In FIG. 6A, the wall section 20 of the curtain rod bracket 10 is placed through the rear wall portion receptacle 36 of the mounting plate 14. In FIG. 6B, the mounting plate 14 is positioned on an upper surface of, for example, a first edge 60 of a window casing 62 with the spike 42 facing downward. Once positioned on the window casing 62, the mounting plate 14 is tapped, for example, with a hammer, causing the spike 42 to penetrate the upper surface of the window casing 62. The result is the mounting mounting plate 14 becoming approximately flush with the upper surface of the window casing 62 and the wall section 20 of the curtain rod bracket 10 approximately flush with a surface such as a wall. In FIG. 6C, the two mounting spikes 18 are then driven through the securing aperture 30 and mounting spike aperture 32, securing the curtain rod bracket 10 on to the window casing 62. The mounting spikes 18 can be any appropriate spike, such as nails. In a preferred embodiment, the mounting spikes 18 are thumb tacks.

The steps shown in FIGS. 6A, 6B and 6C are then repeated for installation of another mountain bracket on another side of the window casing 62.

Figure 7:
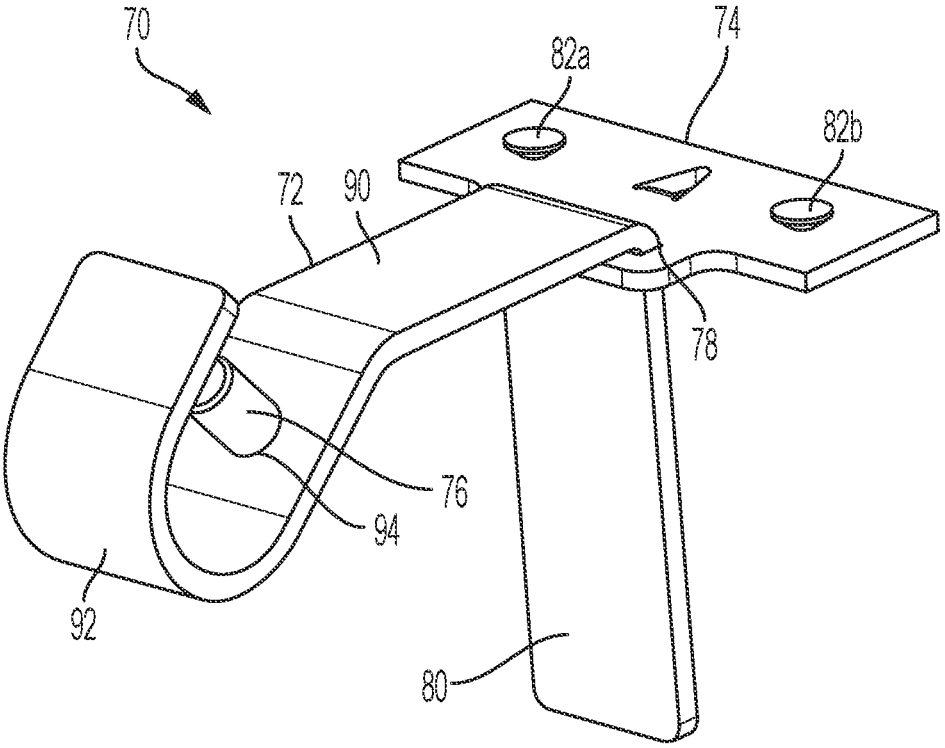
FIG. 7 is a diagram of a second embodiment of an exemplary curtain rod bracket.
Figure 8:
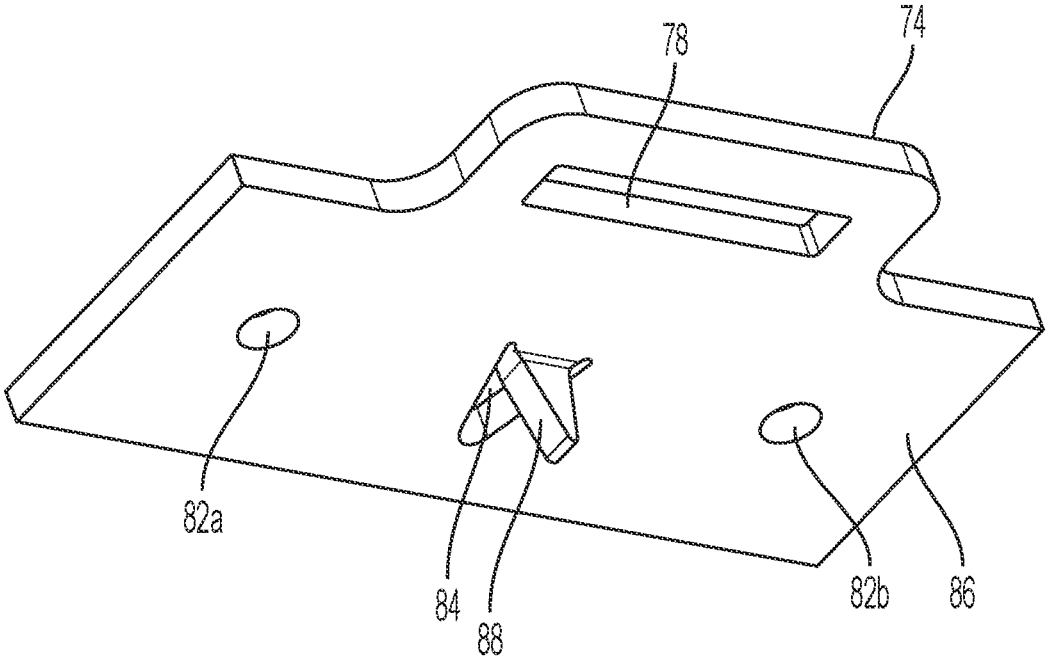
FIG. 8 is a diagram of an underside of the mounting plate of FIG. 7.

As shown in FIGS. 7 and 8, another exemplary embodiment of a curtain rod bracket 70 includes a bracket insert 72, a mounting plate 74 and an adjustable fastener 76. In this embodiment, a top of the mounting plate 74 includes a frontal wall receptacle 78 configured to receive a wall section 80 of the bracket insert 72. The top of the mounting plate 74 also includes two securing apertures 82*a*, 82*b* and a mounting spike aperture 84. A backside (or underside) 86 of the mounting plate 74 includes a spike 88 that aids in initial positioning and securing of the mounting plate 74 along a mounting surface, such as, for example, a top of a window casing.

The bracket insert 72 an extension section 90. A distal end of the extension section 90 includes a cradle portion 92. The cradle portion 92 includes an aperture 94 configured to receive the adjustable fastener 76.

The cradle portion 92 is configured to receive a rod (not shown), such as a curtain rod. Once the rod is placed into the cradle portion 92, the adjustable fastener 76 is placed onto the aperture 94 and rotated until making contact with the rod to secure the rod within the cradle portion 92. In one example, the aperture 94 is threaded to received corresponding threads of the adjustable fastener 76.

The curtain rod bracket 70 may be used, for example, in a central position along a top of a window casing to add strength and stability to a heavy and/or long rod.

Figure 9:
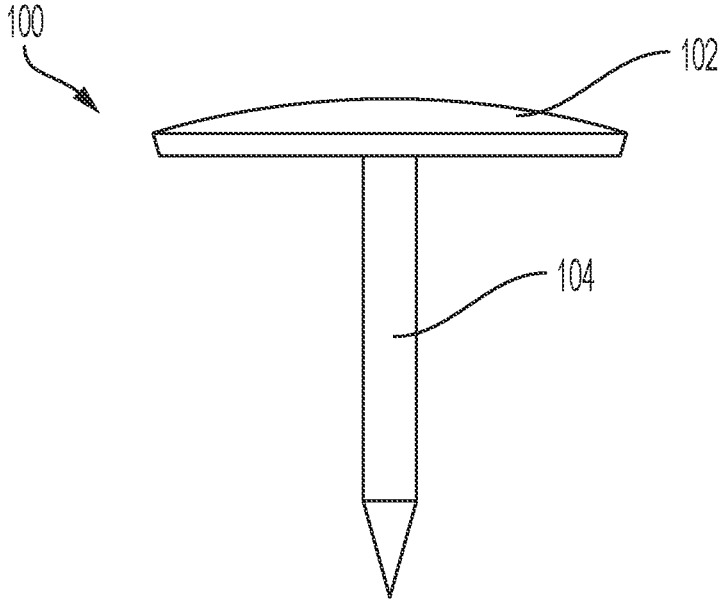
FIG. 9 is a diagram of an exemplary mounting spike.

In FIG. 9, an exemplary mounting spike 100 is illustrated. The mounting spike 100 includes a cold rolled steel head 102 a top of a cold drawn wire 104.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A curtain rod bracket comprising:

a bracket insert having a wall section and an extension section with a distal end-including a cradle portion;

a substantially flat mounting plate forming a planar upper surface, being configured for mounting on a horizontal mounting surface on top of a window casing and including at least one securing aperture extending through the planar upper surface, a mounting spike aperture extending through the planar upper surface and at least one wall portion slot formed therein and extending through the planar upper surface, the at least one wall portion slot being configured to receive at least a portion of the wall section therethrough wherein when the wall section is received within the at least one wall portion slot, a width and weight of the extension section are supported on and by the planar upper surface of the mounting plate, an underside of the mounting plate including a spike configured to aid in an initial positioning and securing of the mounting plate along the horizontal mounting surface, wherein a length of the substantially flat mounting plate and a length of the at least one wall portion slot are parallel; and an adjustable fastener configured to insertably engage an aperture formed in the cradle portion;

wherein the at least one wall portion slot includes a first wall portion slot and a second wall portion slot that is parallel to the first wall portion slot.

2. The curtain rod bracket of claim 1 wherein the bracket insert includes a bend between the wall section and the extension section.

3. The curtain rod bracket of claim 2 wherein the bracket insert bend is 93°.

4. The curtain rod bracket of claim 1 wherein the cradle portion is configured to receive a curtain rod.

5. The curtain rod bracket of claim 1, further comprising mounting spikes configured to insertably engage the at least one securing aperture and mounting spike aperture.

6. The curtain rod bracket of claim 1, wherein the at least one securing aperture includes a first securing aperture and a second securing aperture.

* * * * *